US009373242B1

(12) United States Patent
Conrad et al.

(10) Patent No.: US 9,373,242 B1
(45) Date of Patent: Jun. 21, 2016

(54) SYSTEMS AND METHODS FOR SENSING OCCURRENCES OF HAND WASHING EVENTS

(71) Applicants: Steve Conrad, Huntsville, AL (US); David Ewing, Madison, AL (US)

(72) Inventors: Steve Conrad, Huntsville, AL (US); David Ewing, Madison, AL (US)

(73) Assignee: Synapse Wireless, Inc., Huntsville, AL (US)

( * ) Notice: Subject to any disclaimer, the term of this patent is extended or adjusted under 35 U.S.C. 154(b) by 8 days.

(21) Appl. No.: 14/275,595

(22) Filed: May 12, 2014

Related U.S. Application Data

(60) Provisional application No. 61/835,935, filed on Jun. 17, 2013.

(51) Int. Cl.
*G08B 23/00* (2006.01)
*G08B 21/18* (2006.01)

(52) U.S. Cl.
CPC ..... *G08B 21/18* (2013.01)

(58) Field of Classification Search
CPC ..... G08B 21/245; G08B 21/18; G06F 19/327
USPC ..... 340/573.1
See application file for complete search history.

(56) References Cited

U.S. PATENT DOCUMENTS

2011/0148586 A1* 6/2011 Anderson et al. ..... 340/10.1
2011/0234598 A1* 9/2011 Scarola et al. ..... 340/10.1
2013/0257615 A1* 10/2013 Iseri et al. ..... 340/540

* cited by examiner

*Primary Examiner* — Thomas Mullen
(74) *Attorney, Agent, or Firm* — Maynard Cooper & Gale, P.C.; Jon E. Holland

(57) ABSTRACT

A system for sensing occurrences of hand washing events includes a dispenser of a hand sanitizing solution and a motion sensor that is coupled to the dispenser. The motion sensor is configured to sense vibrations of the dispenser. When at least a threshold amount of movement is sensed, logic is configured to analyze samples from the motion sensor in order to determine whether the sensed vibrations result from activation of the dispenser. If so, the dispenser activation is logged and reported for use within a system, such as a system for monitoring compliance with a hand washing policy.

20 Claims, 16 Drawing Sheets

SYSTEMS AND METHODS FOR SENSING OCCURRENCES OF HAND WASHING EVENTS

CROSS REFERENCE TO RELATED APPLICATION

This application claims priority to U.S. Provisional Patent Application No. 61/835,935, entitled "Systems and Methods for Monitoring Compliance with Hand Washing Policies" and filed on Jun. 17, 2013, which is incorporated herein by reference.

RELATED ART

Healthcare policies often require caregivers, such as nurses or doctors, to wash their hands after entering a patient's room and before touching the patient in an effort to prevent or reduce the occurrences of infections that could complicate a patient's condition. Unfortunately, however, caregivers often do not comply with such policies by approaching or touching patients without washing their hands. In an effort to alleviate this problem, systems for monitoring caregiver compliance with hand washing policies have been developed. Such monitoring systems usually track caregivers and attempt to determine when a caregiver is approaching a patient without washing his or her hands after entering the patient's room. Upon detection of such event, a notification is communicated to the caregiver or other user.

As an example, the caregiver may be warned that he or she is approaching a patient without complying with an applicable hand washing policy thereby reminding the caregiver to wash his or her hands before touching the patient. Also, an administrator may be notified of the event to assist such administrator in determining to what extent applicable hand washing policies are being followed so that he or she can make better management decisions.

Such monitoring systems are usually complicated and expensive and are often plagued with reliability or performance issues. In particular, sensing the relative locations of caregivers and patients can be problematic in healthcare environments, such as large hospitals. Further, even when the location of a particular caregiver can be determined, techniques must be developed for accurately determining when he or she has washed his or her hands. In a large hospital, there can be hundreds or even thousands of caregivers further complicating the decisions made by the monitoring system and also creating a large amount of data that must be processed by the system. Techniques for improving performance and reducing the complexities and costs of such monitoring systems are generally desired.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to systems and methods for sensing occurrences of hand washing events. In one exemplary embodiment, a motion sensor for sensing movement of a dispenser of a hand sanitizing solution is mounted on or otherwise coupled to the dispenser. When at least a threshold amount of movement is sensed, logic is configured to analyze samples from the motion sensor in order to determine whether the sensed movement results from activation of the dispenser. If so, the dispenser activation is logged and reported for use within a system, such as a system for monitoring compliance with a hand washing policy.

Figure 1:
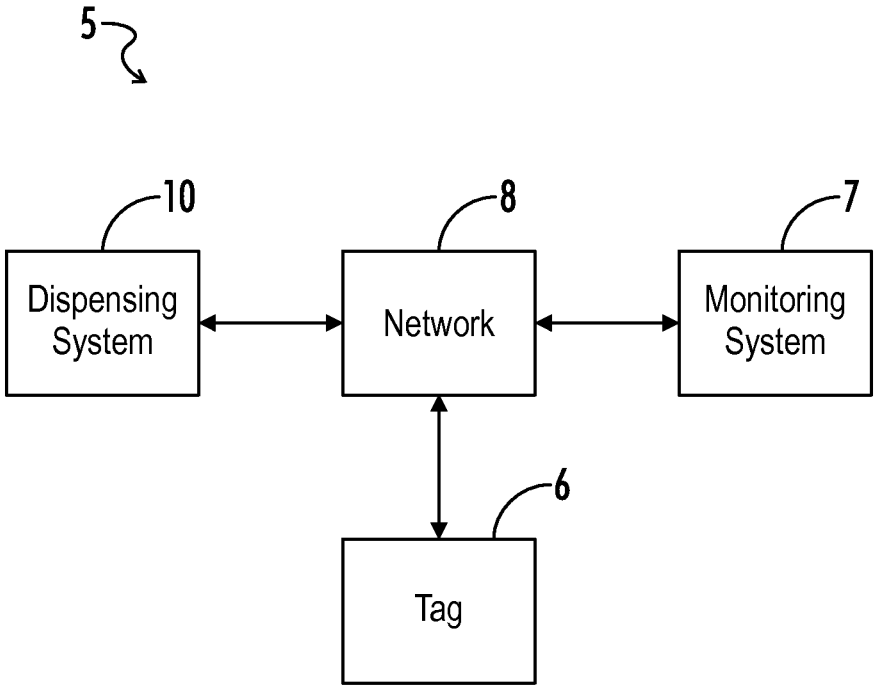
FIG. 1 is a block diagram illustrating an exemplary embodiment of a system for sensing occurrences of hand washing events.

FIG. 1 depicts an exemplary embodiment of a system 5 for sensing occurrences of hand washing events for use in monitoring user compliance with a hand washing policy. As shown by FIG. 1, the system 5 comprises a tag 6 that is carried by a user, such as a caregiver at a healthcare facility. As an example, the tag 6 may be worn by the user or positioned in a pocket of the user such that the tag 6 travels with the user as he or she moves about an area, such as a healthcare facility.

The system 5 further comprises a monitoring system 7 that is configured to communicate with the tag 6 via a network 8. The network 8 comprises a plurality of nodes (not shown) that wirelessly communicate with the tag 6 and communicate messages between the tag 6 and the system 7. The system 7 is configured to communicate with the tag 6 and/or nodes of the network 8 in order to determine the tag's location. As an example, triangulation or other techniques may be used to determine the tag's location.

As shown by FIG. 1, the system 5 further comprises a dispensing system 10 that is configured to dispense a hand sanitizing solution, such as an antibacterial soap or foam, as will be described in more detail hereafter. As an example, the user of the tag 6 may use the dispensing system 10 to dispense a hand sanitizing solution so that the user may wash his or her hands before visiting a patient or some other activity. The dispensing system 10 is configured to determine when hand sanitizing solution is dispensed and reports such occurrences to the system 7 so that the system 7 can use this information in conjunction with the tag location information to determine whether the user of the tag has violated a hand washing policy. In this regard, the system 7 is configured to determine, based on the tag location information, when the user has entered into an area for which washing of the user's hands is required, and the system 7 is further configured to determine, based on information from the dispensing system 10, whether the user has washed his or her hands within a certain time period of entering such area or within a certain proximity of the area. If not, the system 7 senses an occurrence of a hand washing violation and responds by logging and/or reporting the hand washing violation. In other embodiments, other techniques for sensing hand washing violations are possible.

Figure 2:
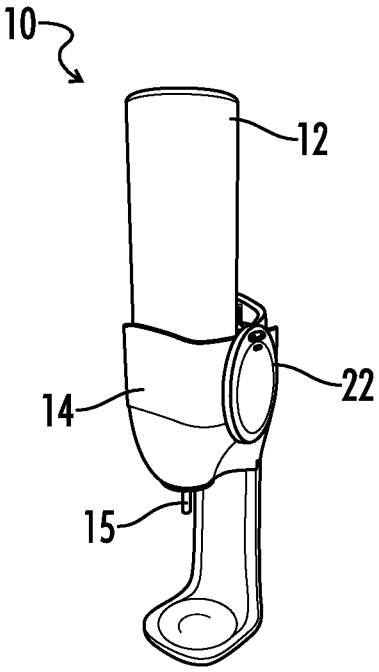
FIG. 2 depicts an exemplary embodiment of a system for dispensing a hand sanitizing solution, such as is depicted by FIG. 1.

FIG. 2 depicts an exemplary embodiment of the dispensing system 10. The system 10 comprises a conventional container 12 in which a hand sanitizing solution is stored under pressure. The container 12 is positioned in a holding apparatus 14, which is mounted on a wall of a building or other structure. The holding apparatus 14 is generally cylindrical having a cavity in which the container 12 is placed, and an end of the holding apparatus 14 is tapered forming an upside-down dome for holding the container 12. The bottom of the holding apparatus 14 has a hole (not shown) through which a nozzle 15 of the container 12 passes.

Such nozzle 15 is positioned at the end of the container 12, and hand sanitizing solution may be dispensed from the container 12 through the nozzle 15. In this regard, when a user presses the nozzle 15 thereby moving the nozzle 15 relative to the container 12, pressure internal to the container 12 is released thereby forcing a portion of the hand sanitizing solution out of the container 12 through the nozzle 15. To stop the flow of hand sanitizing solution, the user may release the nozzle 15 allowing it to return to its original position prior to deflection. The designs of the container 12 and nozzle 15 are generally well known and will not be described in detail herein.

Mounted on a side of the holding apparatus 14 is a sensing module 22 that is configured to sense when a user has activated the system 10 for dispensing the hand sanitizing solution. Such information may be useful for monitoring compliance with hand washing policies. In one exemplary embodiment, the dispensing system 10 is implemented in a healthcare facility having a network 8 (FIG. 1) for tracking healthcare providers and monitoring their compliance with a hand washing policy. When the sensing module 22 senses activation of the system 10 for dispensing the hand sanitizing solution (referred to hereafter as a "hand washing event"), the module 22 is configured to wirelessly transmit a notification of such event via the network 8 so that the event can be used in monitoring compliance with the hand washing policy. As an example, the monitoring system 7 (FIG. 1) may determine whether a hand washing violation occurs based on the notification and the location of the tag 6. Systems for monitoring compliance with hand washing policies are described in commonly-assigned U.S. Provisional Patent Application No. 61/835,935, entitled "Systems and Methods for Monitoring Compliance with Hand Washing Policies" and filed on Jun. 21, 2013, which is incorporated herein by reference. In other embodiments, the information provided by the module 22 may be used for other purposes and in other types of systems.

Various techniques may be used to mount the module 22 on the holding apparatus 14. In one exemplary embodiment, two-sided tape is used to tape the module 22 on the holding apparatus 14. In other embodiments, the module 22 may be glued, screwed, or otherwise coupled in any manner to the holding apparatus 14. In addition, it is possible to position the module 22 at other locations such as mounting the module 22 directly on the container 12 or at other locations where the module 22 can sense vibrations resulting from activation of the dispenser 10.

Figure 3:
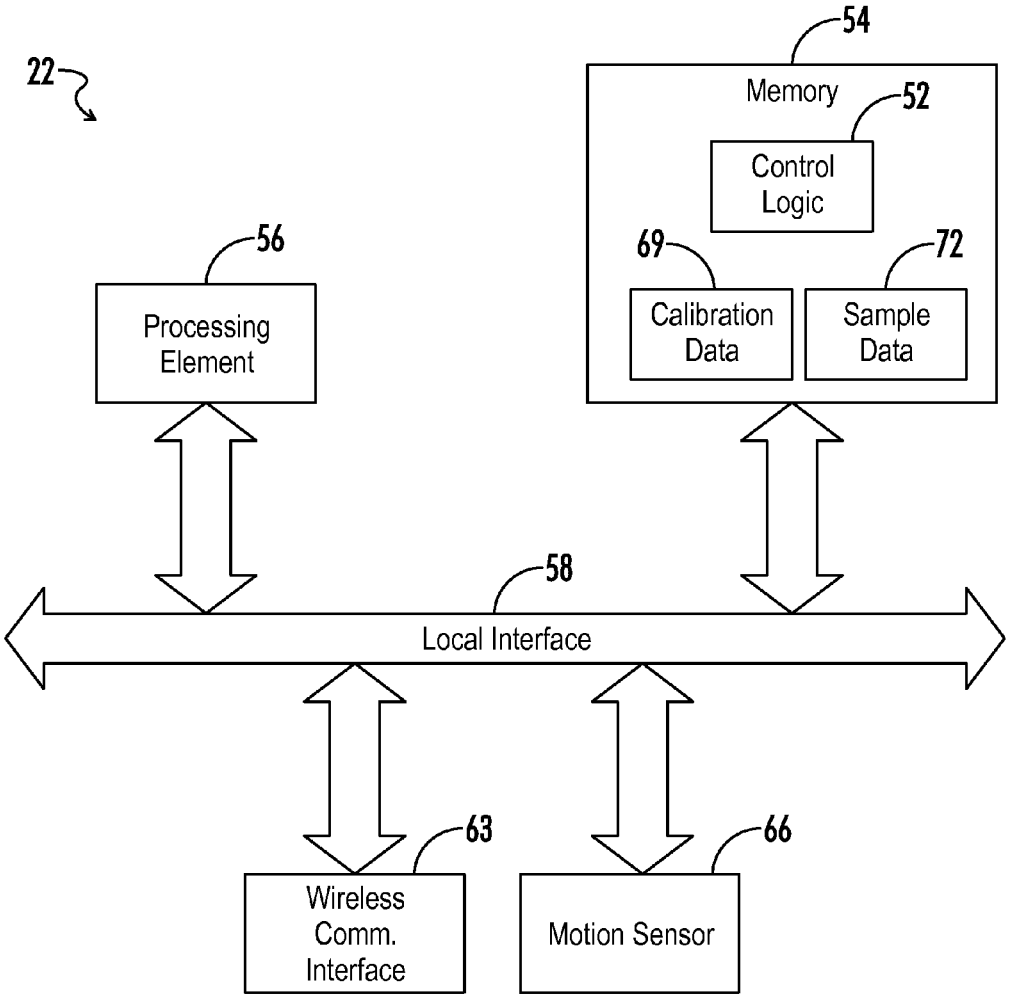
FIG. 3 is a block diagram illustrating an exemplary embodiment of a sensing module, such as is depicted by FIG. 2.

FIG. 3 depicts an exemplary embodiment of the sensing module 22. As shown by FIG. 3, the module 22 comprises control logic 52 for generally controlling the operation of the module 22, as will be described in more detail hereafter. The control logic 52 can be implemented in software, hardware, firmware or any combination thereof. In the exemplary module 22 illustrated by FIG. 3, the control logic 52 is implemented in software and stored in memory 54 of the module 22.

Note that the control logic 52, when implemented in software, can be stored and transported on any computer-readable medium for use by or in connection with an instruction execution apparatus that can fetch and execute instructions. In the context of this document, a "computer-readable medium" can be any means that can contain or store a computer program for use by or in connection with an instruction execution apparatus.

The exemplary module depicted by FIG. 3 comprises at least one conventional processing element 56, such as a digital signal processor (DSP) or a central processing unit (CPU), that communicates to and drives the other elements within the module 22 via a local interface 58, which can include at least one bus. The module 22 also has a wireless communication interface 63 for enabling the module 22 to wirelessly communicate with other devices, such as a network. In one exemplary embodiment, the wireless communication interface 63 is a node of a wireless mesh network, but other types of wireless communication interfaces are possible in other embodiments. Exemplary configurations of wireless network nodes and techniques for communicating wirelessly are described in commonly-assigned U.S. Pat. No. 8,204,971, entitled "Systems and Methods for Dynamically Configuring Node Behavior in a Sensor Network" and filed on May 24, 2011, which is incorporated by reference herein.

The module 22 also has a motion sensor 66 that is configured to sense movement, such as vibrations that may be caused by a user activating the system 10 in order to dispense the hand sanitizing solution from the container 12. In one exemplary embodiment, the motion sensor 66 comprises an accelerometer that senses acceleration. In other embodiments, other techniques and devices for sensing movement are possible.

As described above, a user may dispense the hand sanitizing solution from the container 12 by moving the nozzle 15, and such action creates vibrations that are sensed by the motion sensor 66. The motion sensor 66 is configured to provide sample values in which each sample value indicates a magnitude of the vibration currently sensed by the sensor 66 at the time of a sample. In one exemplary embodiment, each sample value is a measure of the acceleration sensed by the motion sensor 66, but other types of parameters indicative of the sensed vibrations are possible in other embodiments. Based on the sensed vibrations, the control logic 52 is configured to determine when a hand washing event occurs and to then report the event by transmitting a notification message via the wireless communication interface 65 to a remote device.

One technique for detecting a hand washing event is by comparing a sample value to a threshold and detecting an occurrence of a hand washing event if the sample value exceeds the threshold. However, such approach may result in several false detections of a hand washing event. In this regard, vibrations sensed by the motion sensor 66 can originate from many different sources in addition to a hand washing event. As an example, a user knocking on the wall on which the apparatus 14 is mounted can result in vibrations sensed by the motion sensor 66. Such vibrations could cause a sample value to exceed a threshold thereby resulting in a false detection of a hand washing event.

In an effort to prevent false detections of hand washing events, the control logic 52 is configured to filter the sample values received from the motion sensor 66 in order to discern sensed vibrations associated with a hand washing event from other types of sensed vibrations. Various types of filtering algorithms may be used to identify a hand washing event. For illustrative purposes, exemplary filtering algorithms will be described in more detail below, but it should be emphasized that other types of algorithms are possible in other embodiments. In one exemplary embodiment, the motion sensor 66 is configured to provide acceleration values from three axes in which each axis is perpendicular to the other two axes. Further, the control logic 52 may be configured to use sample values from only one axis, although it is possible for the control logic 52 to use sample values from multiple axes if desired.

Through empirical studies, it has been realized that vibrations from a hand washing event generally have different characteristics relative to vibrations from other types of events, which likely occur from a further distance. In this regard, a set of vibrations from a given event, such as a hand washing event or other event, tend to vary wildly initially and after some period of time begin to settle and eventually end. At the point where the vibrations begin to settle, it has been discovered that the average magnitude of vibrations from a hand washing event tend to be greater than the average magnitude of vibrations from other types of events. Based on this realization, filtering algorithms have been developed for discerning vibrations from hand washing events relative to vibrations from other types of events. An exemplary filtering algorithm will now be described in more detail below.

In this regard, the control logic 52 is configured to receive sample values from the motion sensor 66 over time. For example, the control logic 52 is configured to calculate an average of some number of the most recent sample values received from the sensor 66 indicating the average magnitude of vibrations currently sensed by the motion sensor 66 over some time period, such as one second. If the average value is less than a threshold, the control logic 52 is configured to put various components of the module 22 to sleep, such as the processing element 56. Such components are later awakened when a sample value from the sensor 66 exceeds a threshold.

However, before putting components to sleep, the control logic 52 is configured to first perform a calibration function. Specifically, the control logic 52 calculates an average acceleration value, referred to hereafter as the "calibration value," indicative of the average acceleration sensed by the motion sensor 66 for a period of time just before the components are put to sleep. In one embodiment, the control logic 52 averages one-hundred twenty (120) of the most recent samples from the motion sensor 66, but other numbers of sample values may be averaged or otherwise used to calculate the calibration value in other embodiments. The control logic 52 is configured to store the calibration value in memory 54 as calibration data 69.

The module 22 is configured such that the components that were put to sleep after calculating and storing the calibration value are awakened when the motion sensor 66 senses an acceleration value that exceeds a predefined threshold. The vibrations causing such awakening could be from a hand washing event, such as a user moving the nozzle 15, or some other event.

After the components of the module 22 are awakened, the control logic 52 is configured to receive samples from the motion sensor 66 and to store the samples as sample data 72 for a period of time after the awakening. In one exemplary embodiment, the control logic 52 stores one-hundred twenty (120) samples and then analyzes the samples to determine whether a hand washing event is occurring or has occurred. In other embodiments, the detection of a hand washing event can be based on other numbers of samples or samples captured at a different time.

Initially, the control logic 52 analyzes the stored samples to find the earliest point in the sample data 72 where the vibrations being measured by the motion sensor 66 begin to settle, thereby indicating a period of relatively low acceleration measurements, referred to herein as a "quiet period." There are various techniques that can be used to find such a point. In one exemplary embodiment, the control logic 52 starts with the first sample (i.e., the earliest sample) and averages such sample with the next nine samples (i.e., samples 2 through 10) to determine an average acceleration value for a window of ten (10) samples, although the window may have other sample sizes in other embodiments. The control logic 52 compares the calculated average to a threshold. If the calculated average exceeds the threshold, the control logic 52 determines that the samples have yet to settle. In such case, the control logic 52 increments the window by one sample and repeats the aforementioned process. That is, the control logic 52 selects the next sample (i.e., the second sample) and averages such sample with the next nine samples and compares the average of these ten samples to the predefined threshold.

The predefined threshold may be selected empirically. In one exemplary embodiment, the threshold is selected to be 50 meters per second squared ($m/s^2$), but other thresholds may be used in other embodiments.

Once the average acceleration for the window is determined to be below the predefined threshold, the control logic 52 has found the point in the sample data 72 where the vibrations being measured are deemed to begin to settle or, in other words, the start of a quiet period. In such case, the control logic 52 calculates an average acceleration for some number of samples occurring after this identified settling point.

As an example, assume that the window includes samples 50 through 59 when the window's average acceleration value is determined to be below the predefined threshold. In such case, the control logic 52 calculates the average acceleration value for the remaining samples. In particular, the control logic 52 calculates the average acceleration value for samples 60 through 120. In other embodiments, other ones of the sample values may be averaged. As an example, some predefined number of samples after the window (or including samples in the window) may be averaged. In general, it is desirable to average or use some number of samples that occur after the point at which it is determined that the samples are settling.

The control logic 52 compares the foregoing average acceleration value (which indicates an average of values measured after the point at which the samples are determined to be settling) to the calibration value stored in the calibration data 69. As indicated above, this calibration value is measured and stored just before components of the module 22 were put to sleep. If the difference between the average acceleration value and the calibration value exceeds a predefined threshold, then the control logic 52 detects an occurrence of a hand washing event. Otherwise, the control logic 52 determines that the vibrations that caused the module 22 to awaken are caused by some other type of event.

If a hand washing event is detected, the control logic 52 transmits a notification message indicative of the hand washing event via the wireless communication interface 63 or otherwise. If a hand washing event is not detected, the control logic 52 refrains from sending such notification message. In either case, the control logic 52 continues monitoring the samples from the motion sensor 66 until they fall below a predefined threshold for at least a period of time. Once the samples fall below such threshold for the period of time, the control logic 52 is configured to calculate a new calibration value and then to put components of the module 22 to sleep, as described above. Such calibration value will then be used the next time the module 22 awakens to determine whether the vibrations that triggered such awakening result from a hand washing event, as described above.

Note that the threshold that is compared to the difference between the average acceleration value and the calibration value may be empirically determined. In one exemplary embodiment, the threshold is calculated by the control logic 52 to be about 30% of the calibration value. That is, if the absolute value of the difference is determined to be greater than about 30% of the calibration value, then the control logic 52 detects a hand washing event. In other embodiments, other thresholds and/or techniques for sensing an occurrence of a hand washing event are possible.

It should be emphasized that the techniques described above for detecting hand washing events are exemplary. It would be apparent to a person of ordinary skill that various changes and modifications to such techniques are possible. Other exemplary embodiments for detecting hand washing events are described below.

Figure 4:
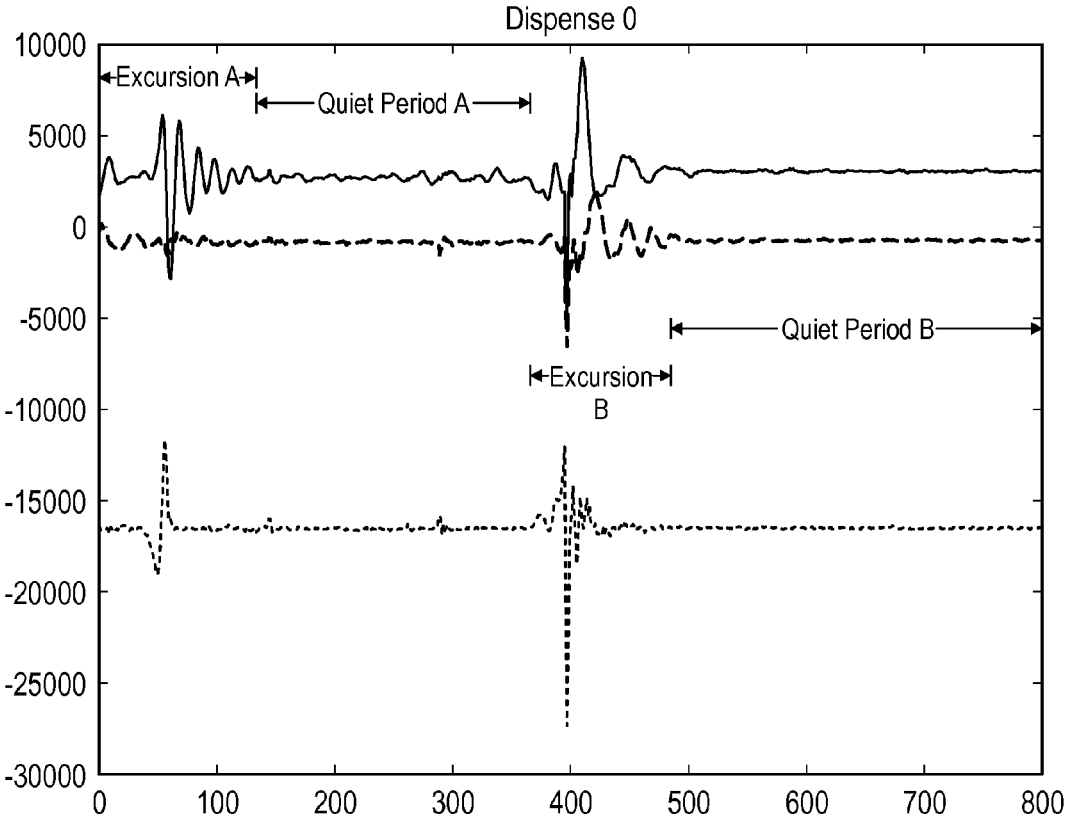
FIG. 4 is a graph illustrating exemplary measurements of a motion sensor, such as is depicted by FIG. 3, during an occurrence of a hand washing event.

In this regard, FIG. 4 depicts a graph showing exemplary acceleration measurements for three axes of the motion sensor 66 over time during a hand washing event. In this regard, the start of the hand washing event occurs when a user moves (e.g., pulls) the nozzle 15 in order to activate dispensing of hand sanitizing solution. The displacement of the nozzle 15 causes vibrations that result in a period of large swings in acceleration values measured by the motion sensor 66. An "excursion" generally refers to an event that causes a higher-than-normal (e.g., above a threshold) motion (e.g., acceleration) measurement by the sensor 66. In FIG. 4, "Excursion A" generally corresponds to the act of a user pressing the nozzle 15 in order to dispense hand sanitizing solution from the container 12. During Excursion A, the rate of change and peak values of the acceleration measurements from the sensor 66 are generally higher than at other times in the absence of an excursion. Thus, the average of the acceleration values measured by the motion sensor 66 during Excursion A is generally higher relative to the acceleration measurements in quiet periods, and the rate of change of acceleration values from one sample to the next during Excursion A is generally greater.

Once the user stops moving the nozzle 15, vibrations decrease, and the measurements from the motion sensor 66 begin to settle marking the beginning of a quiet period, referred to as Quiet Period A in FIG. 4. During such period, the average acceleration measured by the motion sensor 66 is generally less than that for an excursion, and the rate of change of acceleration values from one sample to the next is generally less. Notably, during Quiet Period A, the nozzle 15 is displaced from its original position such that hand sanitizing solution is being dispensed from the container 12.

Once a sufficient amount of hand sanitizing solution has been dispensed, the user releases the nozzle 15 such that it returns to its initial position stopping further dispensing of hand sanitizing solution. This release causes movement of the nozzle 15 and, therefore, an increased level of vibration. In FIG. 4, Excursion B corresponds to the release of the nozzle 15. As shown by FIG. 4, during the period of Excursion B, like the period of Excursion A, the average of the acceleration measured by the motion sensor 66 is generally higher than during quiet periods, and the rate of change of acceleration values from one sample to the next is generally greater.

Once the nozzle 15 stops moving from the release, vibrations decrease, and the measurements from the motion sensor 66 begin to settle marking the beginning of another quiet period, referred to as Quiet Period B in FIG. 4. During such period, the average acceleration measured by the motion sensor 66 is generally less than that for an excursion, and the rate of change of acceleration values from one sample to the next is generally less.

Moreover, FIG. 4 illustrates an exemplary signature of a hand washing event. This signature is characterized by an initial excursion (Excursion A) followed by a quiet period (Quiet Period A) of about 1 second, another excursion (Excursion B), and another quiet period (Quiet Period B). In one exemplary embodiment, the control logic 52 is configured to analyze the samples from the motion sensor 66 in order to identify such signature and to detect an occurrence of a hand washing event when such signature is identified. Note that FIGS. 12-21 depict graphs of other exemplary measurements for three axes of the motion sensor 66 over time for hand washing events.

Note that there are various techniques that can be used to identify the signature of a hand washing event from the measurements by the motion sensor 66. In one exemplary embodiment, the control logic 52 is configured to compare a value based on measurements during Quiet Period A to a value based on measurements during Quiet Period B and to determine whether a hand washing event has occurred based on such comparison.

In this regard, the orientation of the motion sensor 66 may be different during the Quiet Period A relative to the orientation of the motion sensor 66 during the Quiet Period B. In particular, it is sometimes the case that the holding apparatus 14 or other structure on which the module 22 is mounted moves when the user moves the nozzle 15. In addition, as described above, during Quiet Period A, hand sanitizing solution is being dispensed resulting in at least some vibrations, but such dispensing does not occur during Quiet Period B. In addition, the user is still pressing on the nozzle 15 during Quiet Period A but has likely released the nozzle 15 during Quiet Period B. For at least these reasons, it is expected that the average acceleration or other movement sensed by the motion sensor 66 during Quiet Period A should be different than the average acceleration or other movement sensed by the motion sensor 66 during Quiet Period B.

In one exemplary embodiment, the control logic 52 utilizes this difference in order to identify an occurrence of a hand washing event. Specifically, the control logic 52 first identifies quiet periods based on the measurements by the motion sensor 66. For each of two successive quiet periods, the control logic 52 respectively calculates a value indicative of an average acceleration measured by the motion sensor 66. The control logic 52 then compares the value indicative of an average acceleration during the first quiet period to the value indicative of an average acceleration during the next quiet period and detects an occurrence of a hand washing event if the difference of the two values exceeds a predefined threshold. An exemplary configuration and operation of a sensing module 22 for such an embodiment will be described in more detail below.

Specifically, as described above, the module 22 is configured to awaken when the motion sensor 66 detects a movement that exceeds a predetermined threshold. For a hand washing event, it is likely that the module 22 will awaken during Excursion A (FIG. 4). That is, the predetermined threshold for awakening the module 22 is preferably set such that it is likely exceeded by the relatively high acceleration values measured by the motion sensor 66 during Excursion A, which occurs when a user displaces the nozzle 15.

After awakening, the control logic 52 analyzes the acceleration values from the motion sensor 66 in order to identify a quiet period. In one exemplary embodiment, the control logic 52 receives samples from the motion sensor 66 and compares the two most recent samples, as shown by blocks 71-73 of FIG. 5A. That is, the control logic 52 compares the current acceleration value from the motion sensor 66 to the previous acceleration value from the motion sensor 66 or, in other words, the last sample and the penultimate sample in order to determine when a quiet period has begun. In one exemplary embodiment, the control logic 52 subtracts the acceleration values of the two most recent samples and compares the absolute value of this difference to a threshold in order to determine when a quiet period (e.g., Quiet Period A) has begun, as shown by block 74 of FIG. 5A. If the absolute value of the difference of these two values is below a predefined threshold, referred to hereafter as the "quiet period threshold," the control logic 52 determines that the current sample was taken during a quiet period, and Quiet Period A has therefore begun. If the absolute value of the difference is above the quiet period threshold, the control logic 52 determines that the current measurement was taken during an excursion, and Quiet Period A therefore has not yet begun.

Once the start of Quiet Period A is identified, the control logic 52 calculates a running sum of sample values received from the motion sensor 66 during the quiet period. As an example, the control logic 52 determines a running sum of some number (e.g., ten) of acceleration values. While calculating a running sum, the control logic 52 also analyzes the measurements from the motion sensor 66 in order to identify the next excursion, which would be Excursion B in this example. Similar techniques for identifying quiet periods may be used in order to identify excursions. As an example, the control logic 52 may compare the current acceleration value from the motion sensor 66 to the previous acceleration value from the motion sensor 66, as described above. If the difference exceeds the quiet period threshold, the control logic 52 determines that an excursion is occurring. Otherwise, the control logic 52 determines that a quiet period is occurring.

When the control logic 52 detects Excursion B, the control logic 52 stops calculating running sums and stores one of the previously-calculated running sum values, referred to hereafter as the "Quiet-Period-A Value," for later use in identifying a hand washing event. Note that this value could be the running sum of all of the acceleration values measured during Quiet-Period-A, although other values can be used. In one embodiment, the control logic 52 calculates a new running sum for each of a plurality of groups of samples from the motion sensor 66. For example, the control logic 52 may calculate a running sum for the first ten acceleration values, a running sum for the next ten acceleration values, and so on. The control logic 52 may then select as the Quiet-Period-A Value one of the running sum values, such as the last fully-calculated running sum prior to Excursion B. Other techniques are possible for determining the Quiet-Period-A Value, which is indicative of acceleration measurements from the sensor 66 for at least a portion of Quiet Period A.

Note that there are a variety of techniques and algorithms that may be used to calculate the Quiet-Period-A Value and identify Excursion B after sensing the Quiet Period A in block 74. In one exemplary embodiment, the control logic 52 initializes a variable "x" and a variable "Sum" (which represents a running sum value) to a value of 0, as shown by block 81 of FIG. 5A. After receiving a sample of the motion sensor 66 in block 83, the control logic 52 calculates a new value of Sum in block 84 by adding the current value of Sum to the most recent sample value received in block 83. The control logic 52 then increments x and compares x to a threshold (10 in the current example), as shown by blocks 86 and 87. Once x exceeds the threshold, the control logic 52 stores Sum and then re-initializes x and Sum to a value of 0, as shown by blocks 89 and 91 of FIG. 5A.

Figure 5A:
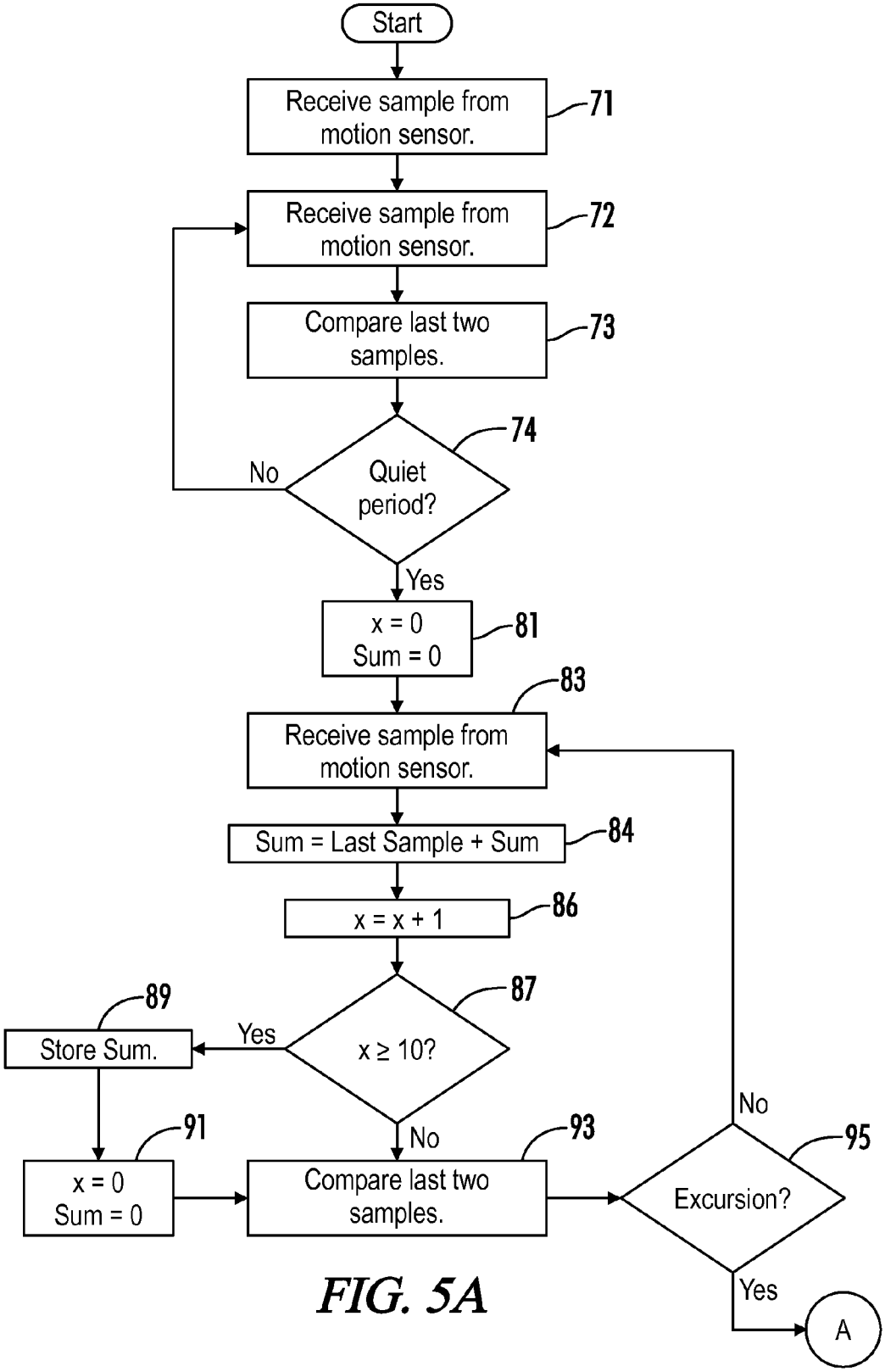
FIGS. 5A and 5B depict a flowchart for illustrating an exemplary method to determine whether motion sensed by the motion sensor is indicative of a hand washing event.
Figure 5B:
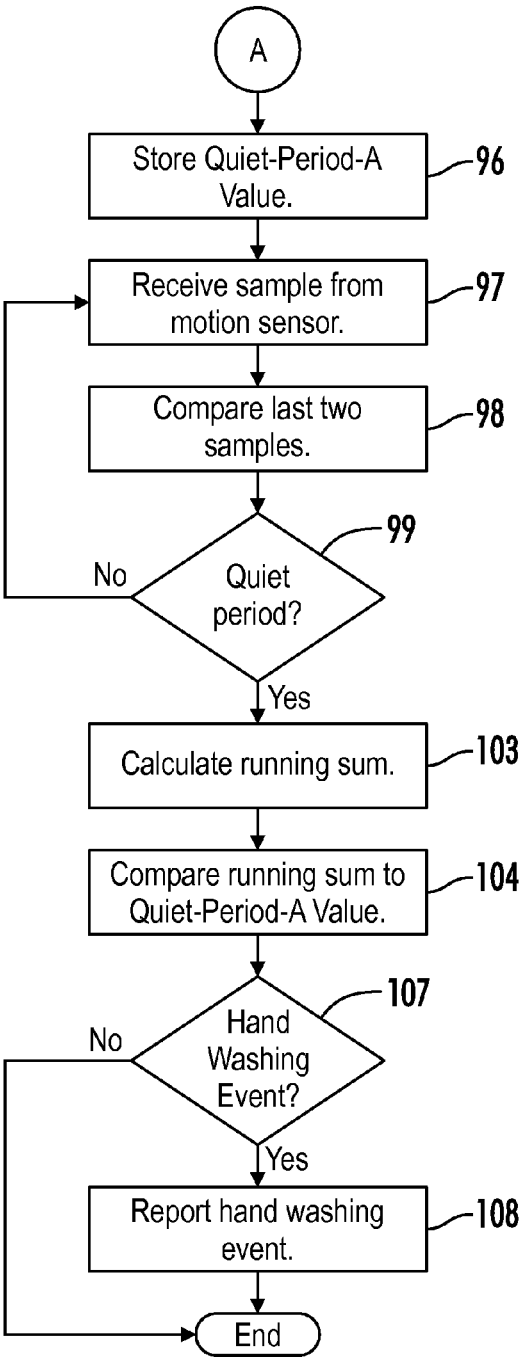

The control logic 52 also compares the two most recent samples and determines whether an excursion (e.g., Excursion B) has begun based on this comparison, as shown by blocks 93 and 95 of FIG. 5A. For example, the control logic 52 may determine that Excursion B has begun and, thus, identify the start of Excursion B when the absolute value of the difference of the two most recent sample values exceeds the quiet period threshold. Once the start of Excursion B is identified in block 95, the control logic 52 selects and stores the Quiet-Period-A Value, as shown by block 96 of FIG. 5B.

After detecting the occurrence of the second excursion (i.e., Excursion B in this example), the control logic 52 analyzes the values from the motion sensor 66 searching for the occurrence of a new quiet period (i.e., Quiet Period B in this example). The same techniques described above for identifying Quiet Period A may be used to identify Quiet Period B. For example, for each received sample in one exemplary embodiment, the control logic 52 compares the two most recent sample values and determines whether a new quiet period (e.g., Quiet Period B) has commenced based on the comparison, as shown by blocks 97-99 of FIG. 5B. Specifically, the control logic 52 subtracts the two most recent sample values and determines whether the absolute value of the difference exceeds the quiet period threshold. If the absolute value of the difference of these two values is below the quiet period threshold, the control logic 52 determines that the current sample was taken during a quiet period, and Quiet Period B has therefore begun. If the absolute value of the difference is above the quiet period threshold, the control logic 52 determines that the current measurement was taken during an excursion, and Quiet Period B therefore has not yet begun.

Once Quiet Period B is detected, the control logic 52 calculates a running sum (referred to hereafter as the "Quiet-Period-B Value") of sample values measured during Quiet Period B, as shown by block 103 of FIG. 5B, and compares this Quiet-Period-B Value to the Quiet-Period-A Value described above, as shown by block 104 of FIG. 5B. Preferably, Quiet-Period-B Value is calculated using the same number of samples as the Quiet-Period-A Value, but a different number of samples may be used if desired. As shown by block 107, the control logic 52 compares the Quiet-Period-B Value to the Quiet-Period-A Value and determines whether a hand washing event has occurred based on such comparison. Specifically, in one exemplary embodiment, if the difference between the Quiet-Period-A Value and Quiet-Period-B Value exceeds a predefined threshold, then the control logic 52 detects an occurrence of a hand washing event. That is, the control logic 52 identifies the signature of a hand washing event and reports the occurrence of such event, as shown by block 108 of FIG. 5B. Alternatively, if desired, the control logic 52 may take some other action in response to the detection of the hand washing event. In addition, rather than comparing running sums, the control logic 52 may compare other types of values indicative of the measurements from the sensor 66. For example, the control logic 52 may be configured to calculate and compare an average of sample values (e.g., acceleration values) measured during Quiet Period A and an average of sample values (e.g., acceleration values) measured during Quiet Period B.

If, however, the control logic 52 determines that the difference between the Quiet-Period-A Value and the Quiet-Period-B Value is below the foregoing threshold, then the control logic 52 determines that a hand washing event has not occurred. That is, the control logic 52 determines that the excursion that triggered the awakening of the module 22 is not from a hand washing event. In such case, the module 22 may return to a sleep state without reporting the occurrence of a hand washing event, or the module 22 may take some other action, as may be desired.

Because there exists a finite delay between the occurrence of the start of Excursion A and the awakening of module 22, it is possible for the control logic 52 to begin receiving samples from the motion sensor 66 after Excursion A has finished. That is, the module 22 may complete its awakening process during Quiet Period A and, therefore, may miss acceleration measurements taken during Excursion A. In such case, the control logic 52 immediately determines (in block 74) that it is in a quiet period after awakening and begins operating as described above for Quiet Period A. In particular, the control logic 52 begins calculating a running sum in Quiet Period A while analyzing the data to determine when the next excursion (i.e., Excursion B in this example) starts. Thus, awakening after the end of Excursion A should not cause the control logic 52 to miss the detection of the hand washing event.

In other embodiments, other types of techniques may be used to determine or assist in the determination of whether measurements from the motion sensor 66 fit a signature profile of a hand washing event. As an example, the control logic 52 may be configured to measure the duration of each respective excursion and/or quiet period and compare a value indicative of such duration to an upper and/or lower threshold. If the duration is determined to be too long or too short to fit the signature profile, the control logic 52 may determine that a hand washing event is not occurring. As an example, as indicated above, it is expected that Quiet Period A for a typical hand washing event should last about one second. After awakening, the control logic 52 may measure the duration of the first quiet period occurring after the awakening. If the duration of this quiet period exceeds a threshold (e.g., four seconds), the control logic 52 may be configured to determine that the excursion that caused the awakening is not from a hand washing event since the duration of the first quiet period following the excursion does not adequately fit the expected profile of a typical hand washing event.

Figure 6:
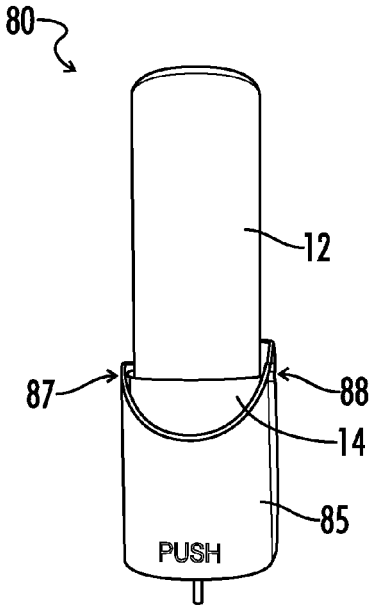
FIG. 6 (PRIOR ART)
FIG. 6 depicts a conventional dispenser of a hand sanitizing solution.

Note that there are various types of dispensers of hand sanitizing solutions, and the techniques described herein for sensing an occurrence of a hand washing event may be used with such other dispensers. As an example, FIG. 6 shows another dispenser 80 that is similar to the one shown by FIG. 2 except that the dispenser 80 has a handle 85 that can be pushed by a user in order to activate the dispenser 80 for dispensing a hand sanitizing solution from the nozzle 15. In this regard, when pushed, the handle 85 pivots about pivot points 87 and 88 such that a bottom of the handle 85 presses against and moves the nozzle 15 causing hand sanitizing solution to be dispensed. When the handle 85 is released, the nozzle 15 returns to its original position stopping the flow of the hand sanitizing solution. The sensing module 22 may be mounted on a side of the handle 85 and may be configured to sense an occurrence of a hand washing event in the same manner as described above for the dispenser 10.

Figure 7:
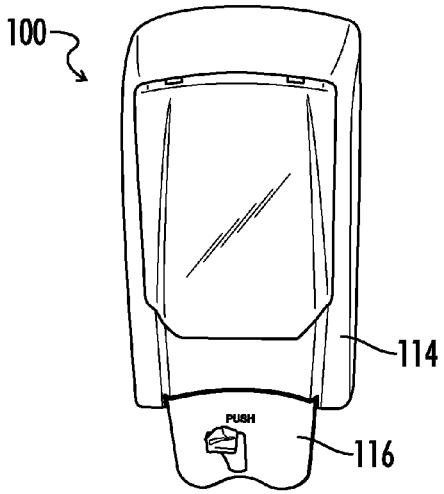
FIG. 7 (PRIOR ART)
FIG. 7 depicts a conventional dispenser of a hand sanitizing solution.
Figure 8:
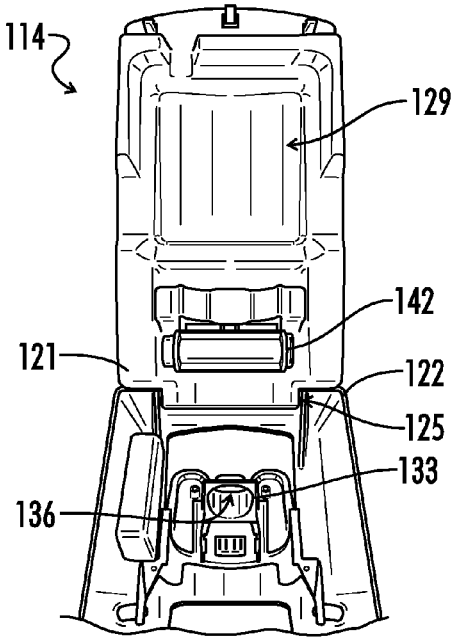
FIG. 8 (PRIOR ART)
FIG. 8 depicts the dispenser of FIG. 7 after a holding apparatus of the dispenser has been opened to show internal components.

FIG. 7 depicts another embodiment of a conventional dispenser 100. As shown by FIG. 7, the dispenser 100 has a holding apparatus 114 that is mounted on a wall or other structure. Such apparatus 114 has an internal cavity (not shown in FIG. 7) in which a container (e.g., a bag) of a hand sanitizing solution, such as soap, may be positioned. FIG. 8 shows the dispenser 100 after the holding apparatus 114 has been opened to show internal components of the apparatus 114. In this regard, the apparatus 114 has a front element 121 that can be rotated relative to a back element 122 in order to open the apparatus 114 for accessing the internal components. Specifically, the front element 121 is coupled to the back element 122 via a hinge 125 about which the front element 121 rotates. The back element 122 is mounted to a wall or other structure and is generally stationary when so mounted.

A container (not shown), such as a bag of soap, may be positioned in an internal cavity 129 of the front element 121 and has a tube (not shown) that extends from the container to a feeder 133 having a hole 136 through which soap or other hand sanitizing solution is dispensed, as will be described in more detail hereafter. To activate the dispenser 100, a user actuates (e.g., presses) the handle 116 (FIG. 7), which is coupled to a press element 142. Movement of the handle 116 by the user pushes the press element 142 against the tube causing the hand sanitizing solution within the tube to be pressed out of the tube through the hole 136. The dispenser 100 is well known in the art. The sensing module 22 may be mounted on a side of the dispenser 100 and may be configured to sense an occurrence of a hand washing event in the same manner as described above for the dispenser 10.

Figure 9:
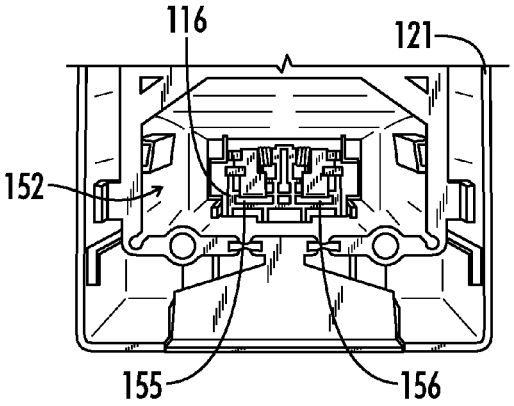
FIG. 9 (PRIOR ART)
FIG. 9 depicts the holding apparatus of FIG. 8 with various components removed to expose a cavity within the holding apparatus.

In one exemplary embodiment, the module 22 is mounted internal to the dispenser 100. In this regard, FIG. 9 shows the front element 121 with various components removed, including the press element 142, in order to show a cavity 152 that is hidden from view by the press element 142 in FIG. 8. In one exemplary embodiment, the module 22 is mounted in this cavity 152. In this regard, a back of the handle 116 is visible through the cavity 152 in FIG. 9. As shown by FIG. 9, the back of the handle 116 has a pair of gaps 155 and 156, and the module 22 is adapted to have a pair of tabs (not shown in FIG. 9) that extend from the module 22 and respectively fit into these gaps snugly in order to secure the module 22 to the back of the handle 116.

Figure 10:
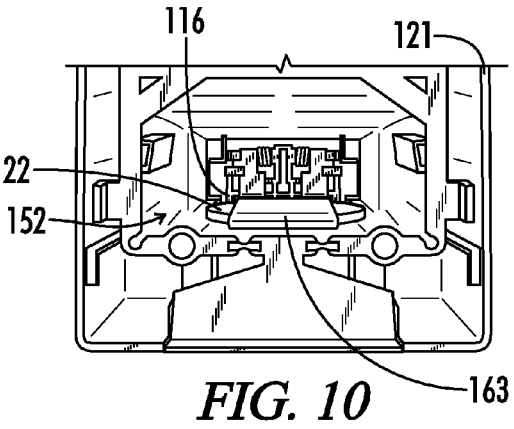
FIG. 10 depicts a sensing module, such as is depicted by FIG. 2, that is coupled to a handle of the dispenser depicted by FIG. 7 in an internal region of such dispenser.
Figure 11:
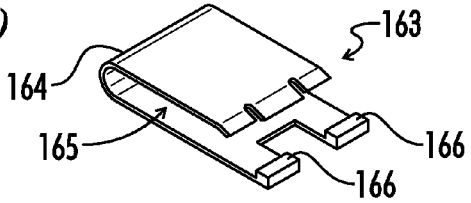
FIG. 11 depicts a module holder that is used to couple the sensing module to the dispenser handle in FIG. 10.
Figure 12:
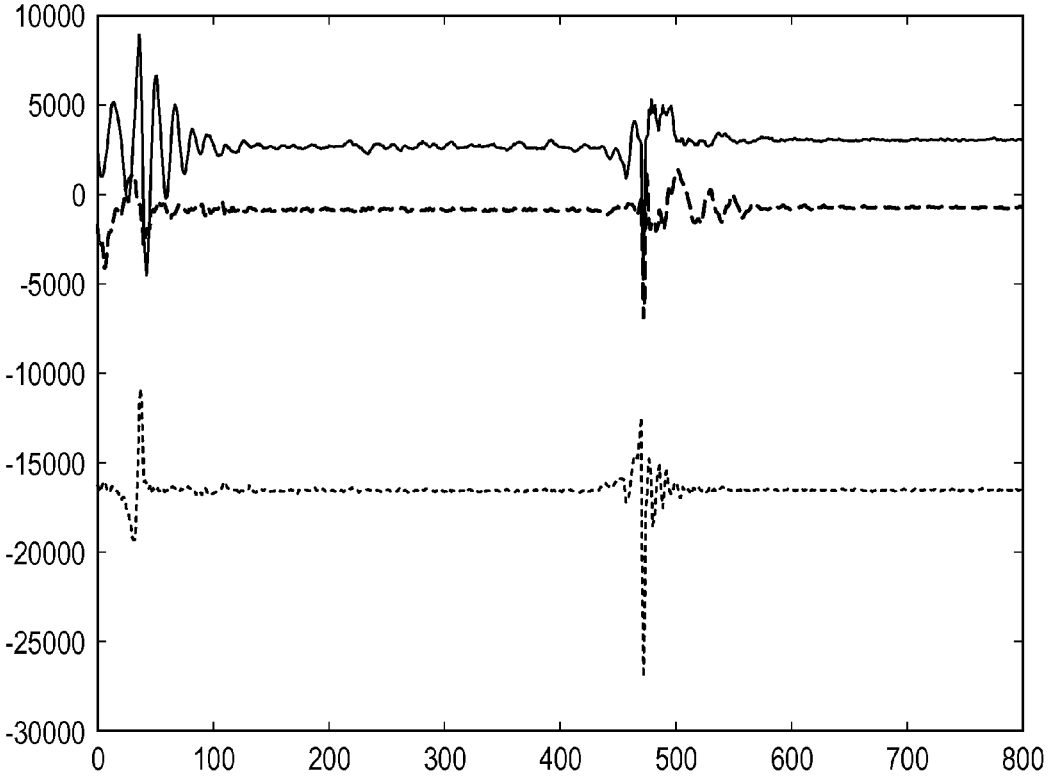
FIGS. 12-21 depict graphs illustrating exemplary measurements of a motion sensor, such as is depicted by FIG. 3, during occurrences of hand washing events.
Figure 13:
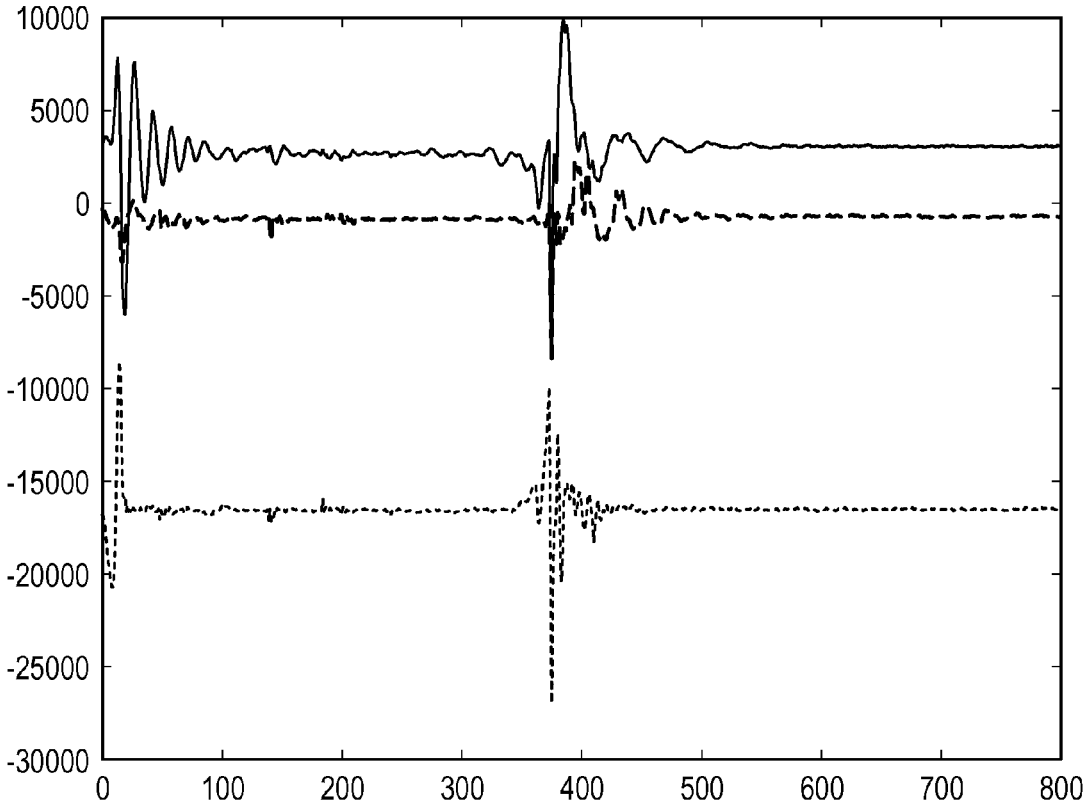
Figure 14:
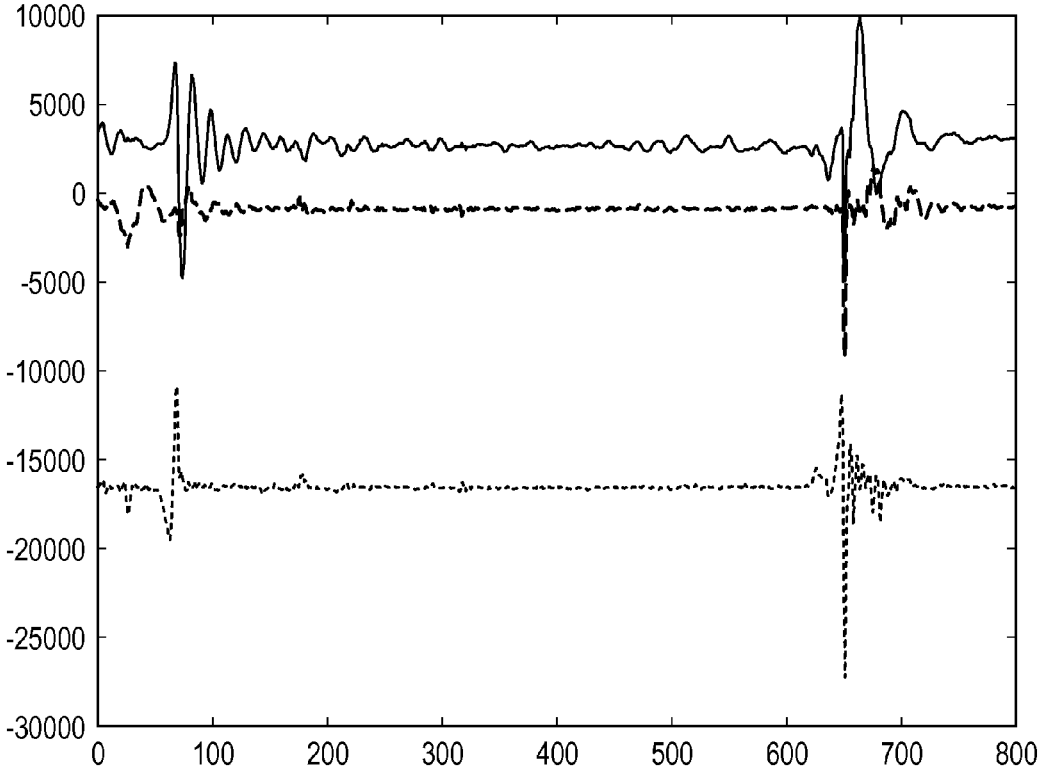
Figure 15:
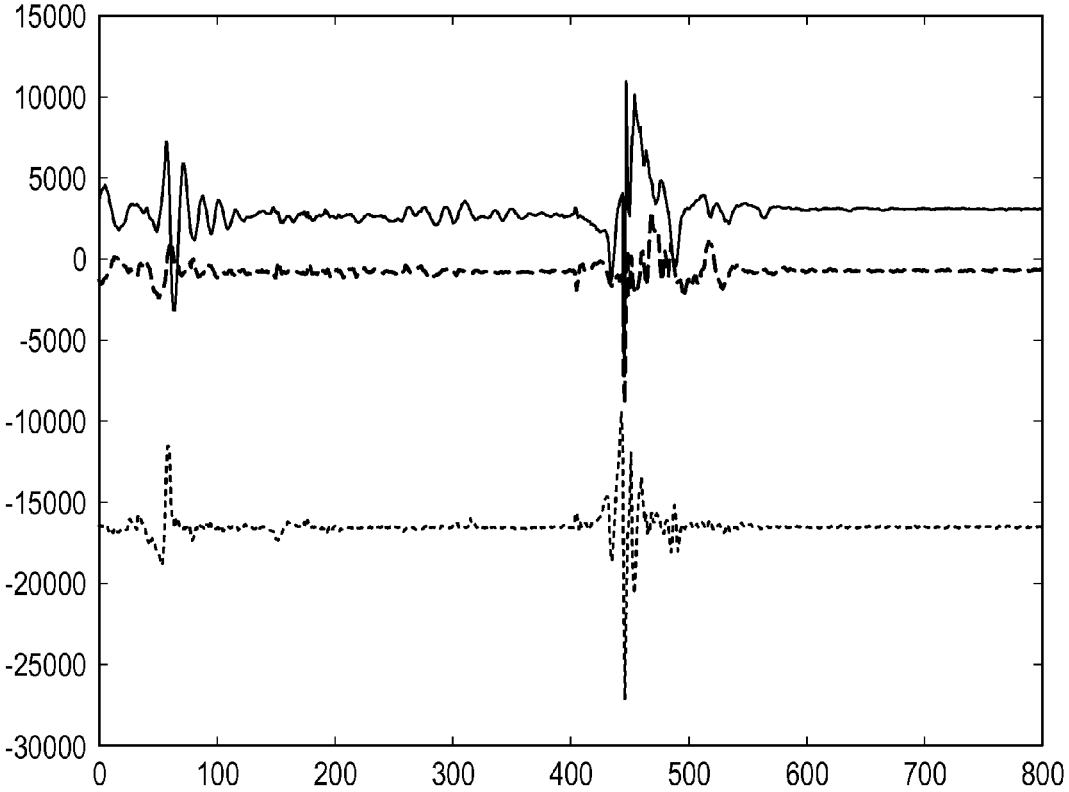
Figure 16:
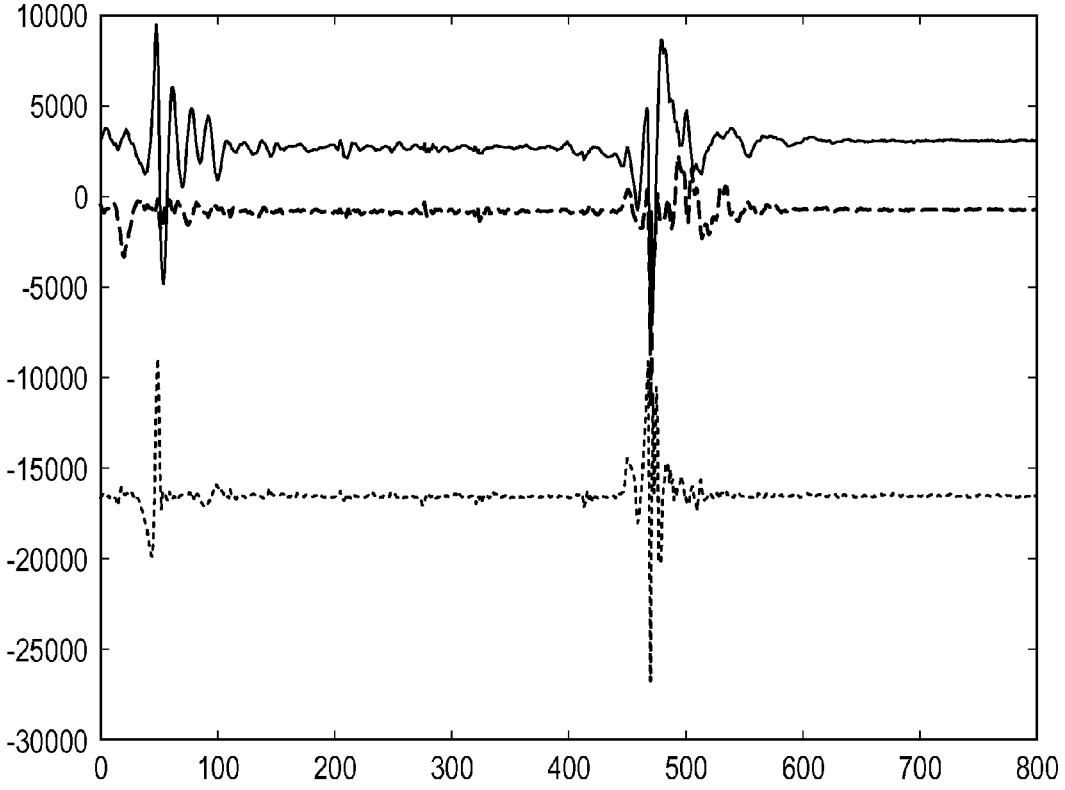
Figure 17:
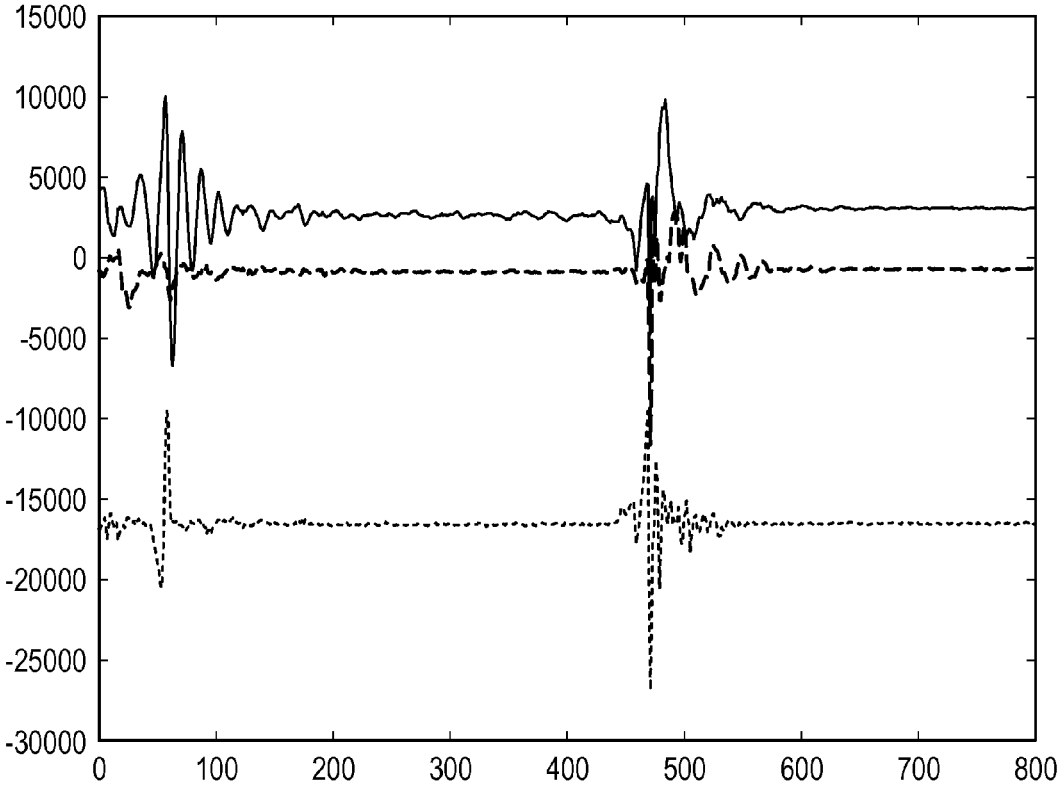
Figure 18:
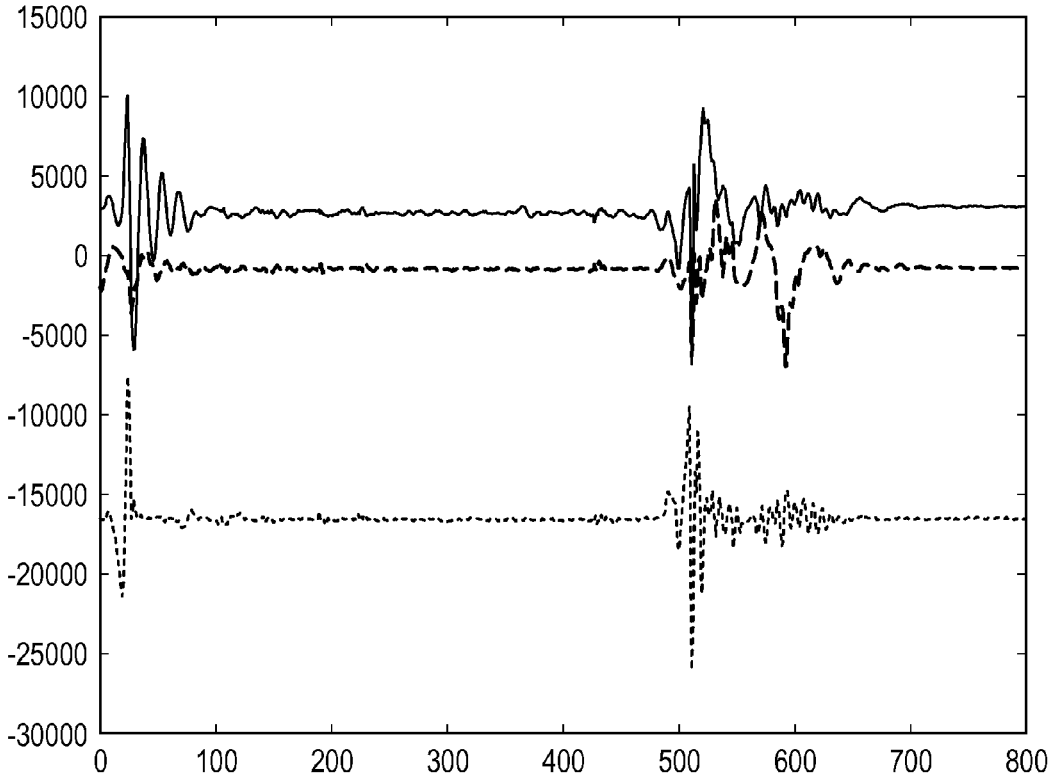
Figure 19:
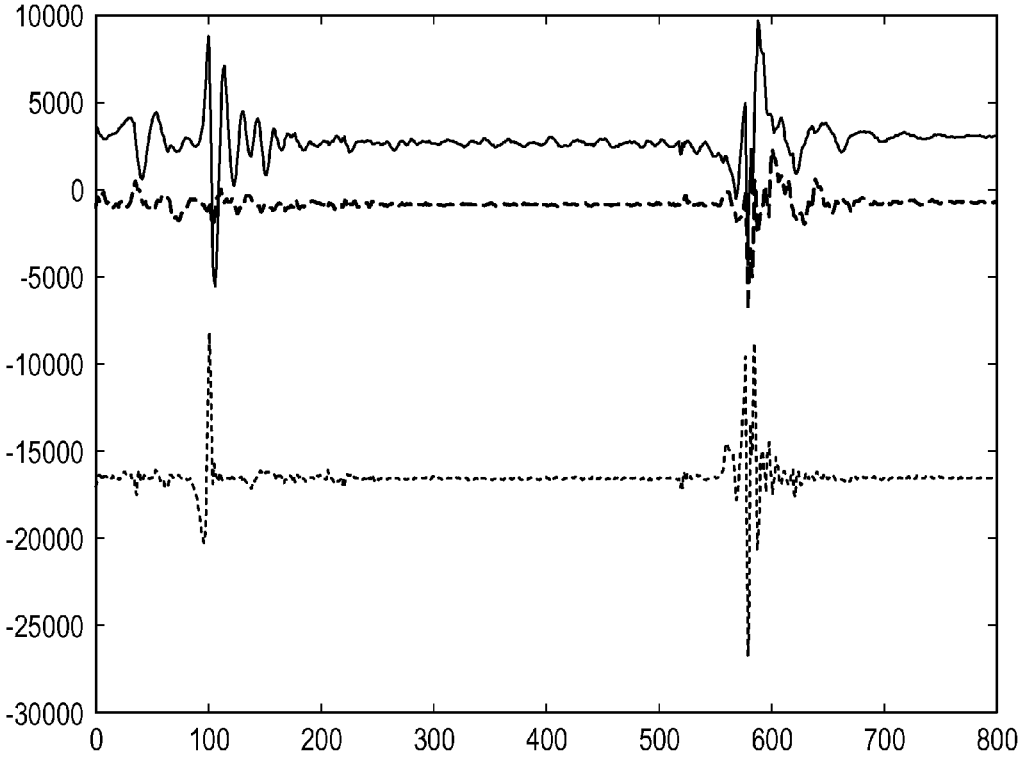
Figure 20:
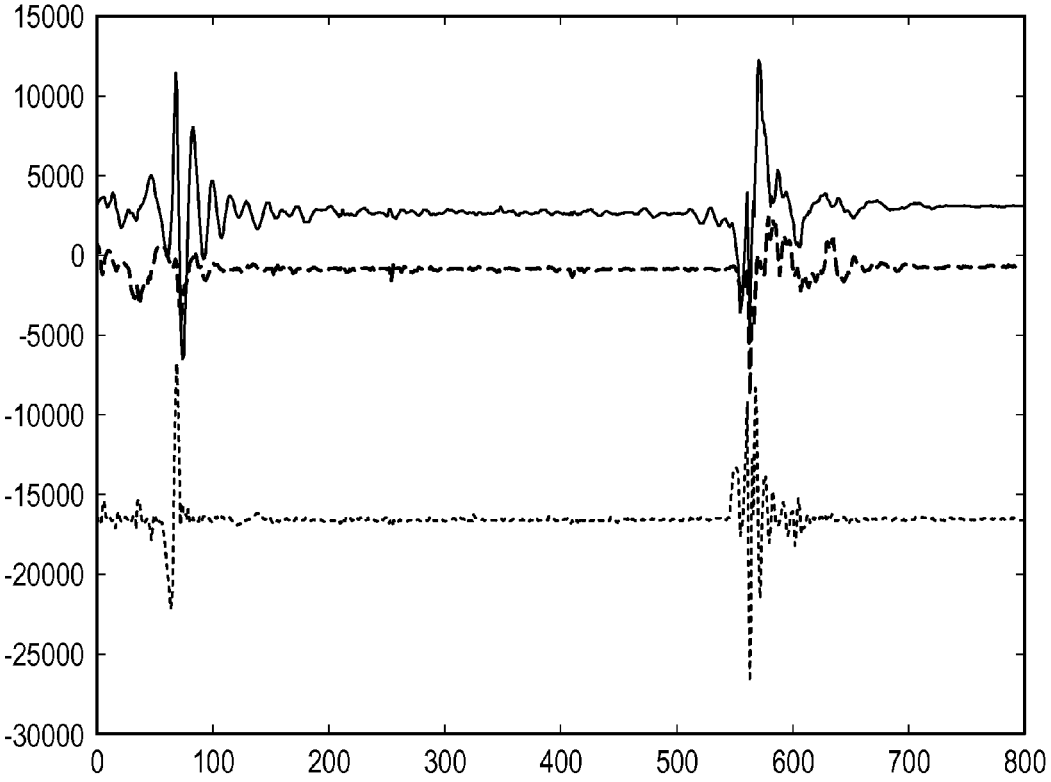
Figure 21:
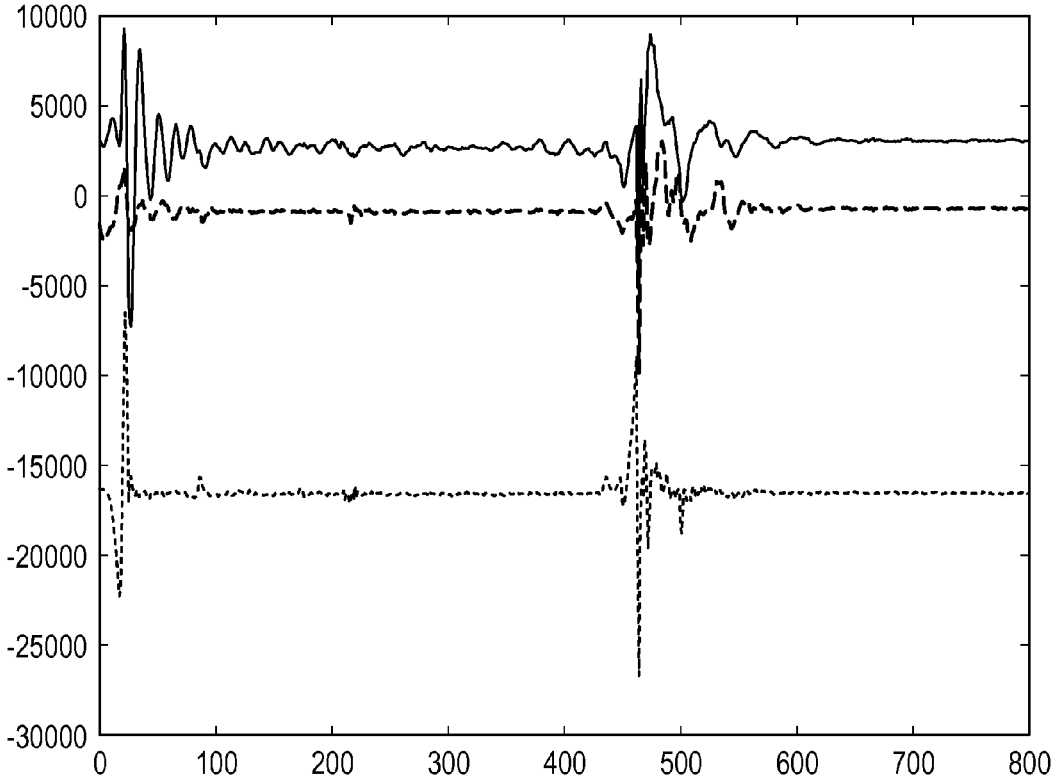

As an example, FIG. 10 shows the module 22 positioned in the cavity 152 and secured to the back of the handle 116. In FIG. 10, the module 22 is inserted into a module holder 163, which is shown in FIG. 11. The holder 163 has a curved body 164 that is U-shaped thereby forming a space 165 in which the module 22 is inserted. The holder 163 is dimensioned such that the body 164 presses on opposite sides of the module such that frictional forces hold the module 22 within the curved body 164. As shown by FIG. 11, a pair of tabs 166 extends from one end of the body 164, and each tab 166 is dimensioned such that it snugly fits within a respect hole 155, 156 of the handle 116. This snug fits secures the holder 163 and, hence, the module 22 are secured to the handle 116. In other embodiments, other techniques and configurations may be used for positioning the module 22 internal to a dispenser and/or coupling the module 22 to a handle 116 that is pressed or otherwise actuated in order to activate dispensing of hand sanitizing solution from the dispenser 100.

Note that having the module 22 coupled directly to the handle 116 that is used to activate the dispenser 100 has various advantages. In this regard, when a user presses the handle 116, the vibrations resulting from such action are likely to be higher as measured by the module 22. Thus, a higher threshold may be used for determining when to awaken the module 22 for the purpose of determining whether a hand washing event is occurring. Having a higher threshold results in fewer awakenings and possibly fewer false detections of a hand washing event since at least some vibrations that otherwise would trigger an awakening are prevented from exceeding the threshold. In an embodiment in which the electrical components of the module 22 are powered by a battery, the higher threshold can help extend the life of the battery. In addition, having the module 22 mounted internal to the dispenser 100 helps to hide the module 22 from view. Some users may prefer the module 22 to be hidden from view for aesthetic or other reasons.

Now, therefore, the following is claimed:

1. A system for sensing hand washing events, comprising:

a dispenser for dispensing a hand sanitizing solution;

a motion sensor coupled to the dispenser, the motion sensor configured to sense vibrations of the dispenser and to provide data indicative of the sensed vibrations;

logic configured to detect an occurrence of a hand washing event based on the data, the logic further configured to transmit a message indicating the occurrence of the hand washing event;

a tag; and a monitoring system configured to determine a location of the tag, the monitoring system further configured to determine whether a violation of a hand washing policy has occurred based on the location of the tag and the message indicating the occurrence of the hand washing event, wherein the occurrence of the hand washing event is characterized by a first excursion, a second excursion, and a quiet period, wherein the first excursion corresponds to an event where a user is displacing a component of the dispenser from an original position for activating dispensing of the hand sanitizing solution from the dispenser, wherein the second excursion corresponds to an event that causes the component to return to the original position after displacement of the component by the user, wherein the quiet period corresponds to a time period between the first and second excursions after vibrations from displacement of the component for the first excursion have begun to settle such that a rate of change of the vibrations is below a threshold, wherein the logic is configured to detect the quiet period based on samples from the motion sensor and to identify at least one sample measured by the motion sensor during the quiet period, and wherein the logic is configured to detect the occurrence of the hand washing event based on the identified sample.

2. A system for sensing hand washing events, comprising:

a dispenser for dispensing a hand sanitizing solution;

a motion sensor coupled to the dispenser, the motion sensor configured to sense vibrations of the dispenser and to provide data indicative of the sensed vibrations, wherein the data defines a plurality of samples from the motion sensor indicative of a plurality of vibrations of the dispenser caused by a displacement of a component of the dispenser by a user for activating dispensing of the hand sanitizing solution from the dispenser; and logic configured to detect an occurrence of a hand washing event based on the data, the logic further configured to transmit a message indicating the occurrence of the hand washing event, wherein the logic is configured to identify at least one of the samples indicative of vibrations of the dispenser caused by the displacement after a rate of change of the plurality of vibrations has fallen below a predefined threshold, and wherein the logic is further configured to detect the occurrence of the hand washing event based on the identified sample.

3. The system for sensing hand washing events of claim 2, wherein the motion sensor comprises an accelerometer for sensing the vibrations.

4. The system for sensing hand washing events of claim 2, wherein the logic is configured to filter the samples in order to distinguish hand washing events from other events that cause vibrations of the dispenser.

5. The system for sensing hand washing events of claim 2, wherein the logic is configured to perform a comparison between the identified sample and at least one sample from the motion sensor indicative of vibrations of the dispenser after the user has deactivated the dispensing of the hand sanitizing solution.

6. A system for sensing hand washing events, comprising:

a dispenser for dispensing a hand sanitizing solution;

a motion sensor coupled to the dispenser, the motion sensor configured to sense vibrations of the dispenser and to provide data indicative of the sensed vibrations; and logic configured to detect an occurrence of a hand washing event based on the data, the logic further configured to transmit a message indicating the occurrence of the hand washing event and to perform a comparison between a first value and a second value, the first value indicative of at least one sample from the motion sensor indicative of vibrations of the dispenser after a user has provided an input to the dispenser for activating dispensing of the hand sanitizing solution from the dispenser, the second value indicative of at least one sample from the motion sensor indicative of vibrations of the dispenser after the user has provided an input to the dispenser for deactivating the dispensing, wherein the logic is configured to sense the occurrence of the hand washing event based on the comparison.

7. The system for sensing hand washing events of claim 6, wherein the dispenser has a handle for activating dispensing of the hand sanitizing solution from the dispenser, and wherein the motion sensor is coupled to the handle.

8. The system for sensing hand washing events of claim 7, wherein the motion sensor is internal to the dispenser.

9. The system for sensing hand washing events of claim 6, further comprising:

a tag; and a monitoring system configured to receive the message and to determine a location of the tag, the monitoring system further configured to determine whether a violation of a hand washing policy has occurred based on the location of the tag and the message.

10. The system for sensing hand washing events of claim 9, further comprising a network having a plurality of nodes for wirelessly communicating with the tag, wherein the monitoring system is configured to communicate with the nodes and to determine the location of the tag based on at least one message communicated between the tag and the plurality of nodes.

11. A system for sensing hand washing events, comprising:

a dispenser for dispensing a hand sanitizing solution;

a motion sensor coupled to the dispenser, the motion sensor configured to sense vibrations of the dispenser and to provide data indicative of the sensed vibrations; and logic configured to detect an occurrence of a hand washing event based on the data, the logic further configured to transmit a message indicating the occurrence of the hand washing event, wherein the occurrence of the hand washing event is characterized by a first excursion, a second excursion, and a quiet period, wherein the first excursion corresponds to an event where a user is displacing a component of the dispenser from an original position for activating dispensing of the hand sanitizing solution from the dispenser, wherein the second excursion corresponds to an event that causes the component to return to the original position after displacement of the component by the user, wherein the quiet period corresponds to a time period between the first and second excursions after vibrations from displacement of the component for the first excursion have begun to settle such that a rate of change of the vibrations is below a threshold, and wherein the logic is configured to detect the quiet period based on samples from the motion sensor and to identify at least one sample measured by the motion sensor during the quiet period.

12. The system for sensing hand washing events of claim 11, wherein the logic is further configured to perform a comparison between a value indicative of the at least one sample identified by the logic with a value indicative of at least one sample measured by the motion sensor after the second excursion, and wherein the logic is configured to sense the occurrence of the hand washing event based on the comparison.

13. A method for sensing hand washing events, comprising:

dispensing hand sanitizing solution from a dispenser in response to a user input to the dispenser;

sensing vibrations of the dispenser via a motion sensor coupled to the dispenser;

analyzing data from the motion sensor indicative of the sensed vibrations;

determining, based on the analyzing, a first value indicative of at least one sample from the motion sensor indicative of vibrations of the dispenser after the user input;

determining, based on the analyzing, a second value indicative of at least one sample from the motion sensor indicative of vibrations of the dispenser after the user has provided a user input to the dispenser for deactivating the dispensing;

comparing the first value and the second value;

detecting an occurrence of a hand washing event based on the comparing; and transmitting a message indicating the occurrence of the hand washing event in response to the detecting.

14. The method of claim 13, further comprising:

monitoring a tag carried by a user;

determining a location of the tag based on the monitoring; and determining whether a violation of a hand washing policy has occurred based on the message and the determined location of the tag.

15. The method of claim 13, wherein the motion sensor comprises an accelerometer.

16. The method of claim 13, further comprising moving a handle of the dispenser, wherein the dispensing is performed in response to the moving, and wherein the motion sensor is coupled to the handle and is internal to the dispenser.

17. A method for sensing hand washing events, comprising:

dispensing hand sanitizing solution from a dispenser;

sensing vibrations of the dispenser via a motion sensor coupled to the dispenser;

analyzing data from the motion sensor indicative of the sensed vibrations;

detecting an occurrence of a hand washing event based on the analyzing, wherein the occurrence of the hand washing event is characterized by a first excursion, a second excursion, and a quiet period, wherein the first excursion corresponds to an event where a user is displacing a component of the dispenser from an original position for activating dispensing of the hand sanitizing solution from the dispenser, wherein the second excursion corresponds to an event that causes the component to return to the original position after displacement of the component by the user, wherein the quiet period corresponds to a time period between the first and second excursions after vibrations from displacement of the component for the first excursion have begun to settle such that a rate of change of the vibrations is below a threshold;

transmitting a message indicating the occurrence of the hand washing event in response to the detecting;

detecting the quiet period based on samples from the motion sensor; and identifying, based on the detecting, at least one sample measured by the motion sensor during the quiet period.

18. The method of claim 17, further comprising:

determining a first value indicative of the at least one sample;

determining a second value indicative of at least one sample measured by the motion sensor after the second excursion; and comparing the first value and the second value, wherein the detecting the occurrence of the hand washing event is based on the comparing.

19. A method for sensing hand washing events, comprising:

dispensing hand sanitizing solution from a dispenser;

sensing vibrations of the dispenser via a motion sensor coupled to the dispenser;

displacing a component of the dispenser, thereby causing vibrations of the dispenser, wherein the dispensing is performed in response to the displacing;

analyzing data from the motion sensor indicative of the sensed vibrations, wherein the data defines a plurality of samples from the motion sensor indicative of vibrations of the dispenser caused by the displacing;

determining based on the samples when a rate of change of the vibrations caused by the displacing falls below a threshold; and identifying, based on the determining, at least one of the samples indicative of vibrations of the dispenser occurring after the rate of change falls below the threshold;

detecting an occurrence of a hand washing event based on the identifying; and transmitting a message indicating the occurrence of the hand washing event in response to the detecting.

20. The method of claim 19, further comprising comparing the identified sample and at least one sample from the motion sensor indicative of vibrations of the dispenser after the displacing, wherein the detecting is based on the comparing.

* * * * *